US005156538A

United States Patent [19]

Lee

[11] Patent Number: 5,156,538

[45] Date of Patent: Oct. 20, 1992

[54] MANUAL PUMP

[76] Inventor: Tju-Chi Lee, No. 14, Alley 2, La. 118, Sec. 2, Ho-Ping E. Rd., Taipei City, Taiwan

[21] Appl. No.: 775,144

[22] Filed: Oct. 9, 1991

[51] Int. Cl.[5] ..... F04B 39/10

[52] U.S. Cl. ..... 417/571; 417/236; 417/239; 417/442

[58] Field of Search ..... 417/571, 569, 236, 238, 417/239, 442

[56] References Cited

U.S. PATENT DOCUMENTS 5,071,325 12/1991 Tupper et al. ..... 417/571

*Primary Examiner*—Richard A. Bertsch

*Assistant Examiner*—Charles G. Freay

*Attorney, Agent, or Firm*—Morgan & Finnegan

[57] ABSTRACT

An elongated tubular member has an upper closed end and a lower closed end with a first opening. It also has a second opening on its wall and a suction unit movable within the same. A first tubular member has a top open end and a constricted bottom end. The first tubular member has a first inflow and outflow check valve circumferentially spaced from the first inflow check valve. A partition provided adjacent to he constricted bottom end of the first tubular member has a third opening and second inflow and outflow check valves. The elongated tubular member resides rotatably and engageably in the first tubular member.

3 Claims, 5 Drawing Sheets

MANUAL PUMP

BACKGROUND OF THE INVENTION

1. Field of the Invention

This invention relates to a pump, more specifically to a manual pump which is used to plunge through a blocked passage of a pipe and the like.

2. Description of the Related Art

We generally use a plunger to plunge through a blocked passage of a pipe and the like. During the plunging operation, the suction cup of the plunger which is used to push through the passage often disengages from the plunging rod and is left in the passage of the pipe we are working on, blocking the already inaccessible passage.

Alternatively, a bucket of water is poured violently and forcefully into the blocked passage in order to make the passage accessible. It is found that manually plunging and pouring water seldom reap fruit at all, resulting only in a waste of time and energy.

SUMMARY OF THE INVENTION

It is the main object of the present invention to provide a pump operable manually which pump can be used to plunge through a blocked passage of a pipe and the like, an object not achievable by the above-mentioned methods.

According to the present invention, the manually operable pump includes a elongated tubular member and a first tubular member. The elongated tubular member has an upper closed end, a lower closed end with a first opening, and a first wall body with a second opening which connects the upper closed end to the lower closed end. A suction plate is provided in the elongated tubular member, the edge of the suction plate forming a hermetical seal with the walls of the elongated tubular member. A pushing rod includes a first end centrally connected to the suction plate and a second end that extends through the upper closed end and out of the elongated tubular member. The first tubular member includes an upper open end, a lower constricted end, and a second wall body with a first inlet valve and a first delivery valve circumferentially spaced from the first inlet valve. The first inlet and delivery date valves respectively correspond to the second opening of the first wall body. A partition with a third opening as well as a second inlet and delivery valve is provided in the first tubular member adjacent to the constricted bottom end, dividing the first tubular member into an upper portion and a lower portion. The third opening and the second inlet and delivery valves, respectively, correspond to the first opening of the lower closed end of the elongated tubular member. The elongated tubular member is rotatably inserted into the upper portion of the first tubular member in such a manner that the closed end of the former is in close contact with the partition of the latter. The former also has a marked indicator aligned with the second opening of the first wall body. When the elongated tubular member is turned in the upper portion of the first tubular member, the first and second opening of the same can be selectively aligned with the corresponding first inlet or delivery valve and with the corresponding third opening or second inlet or delivery valves of the first tubular member.

BRIEF DESCRIPTION OF THE DRAWINGS

Other features and advantages of the present invention will become apparent in the following detailed description, including drawings, all of which show a non-limiting form of the invention and of which.

DETAILED DESCRIPTION OF THE PREFERRED EMBODIMENT

Figure 1:
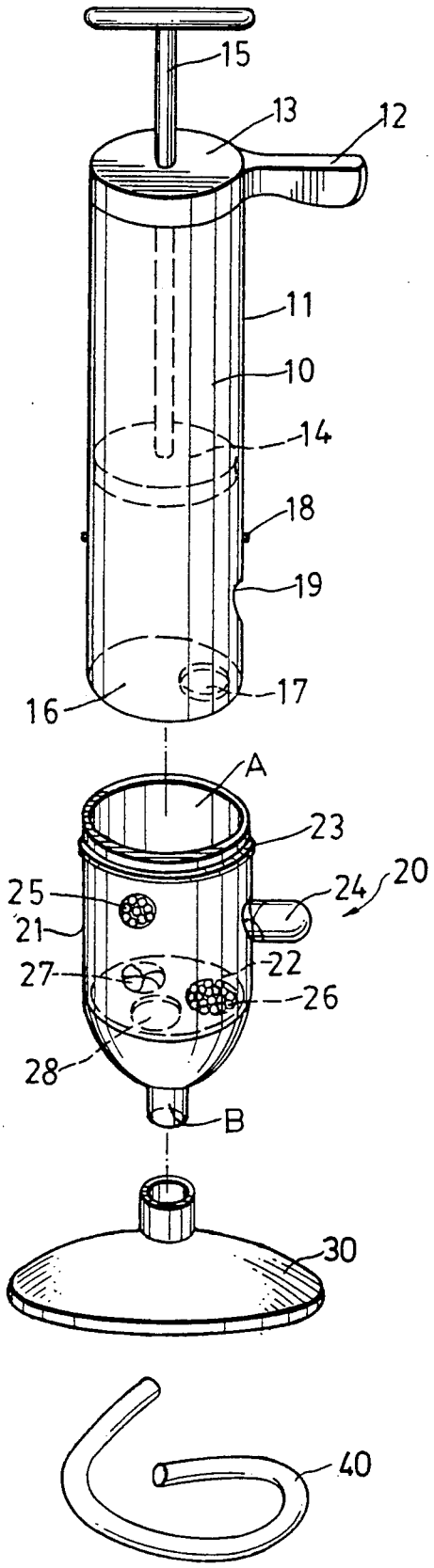
FIG. 1 is an exploded view of a manually operable pump of the present invention.
Figure 2:
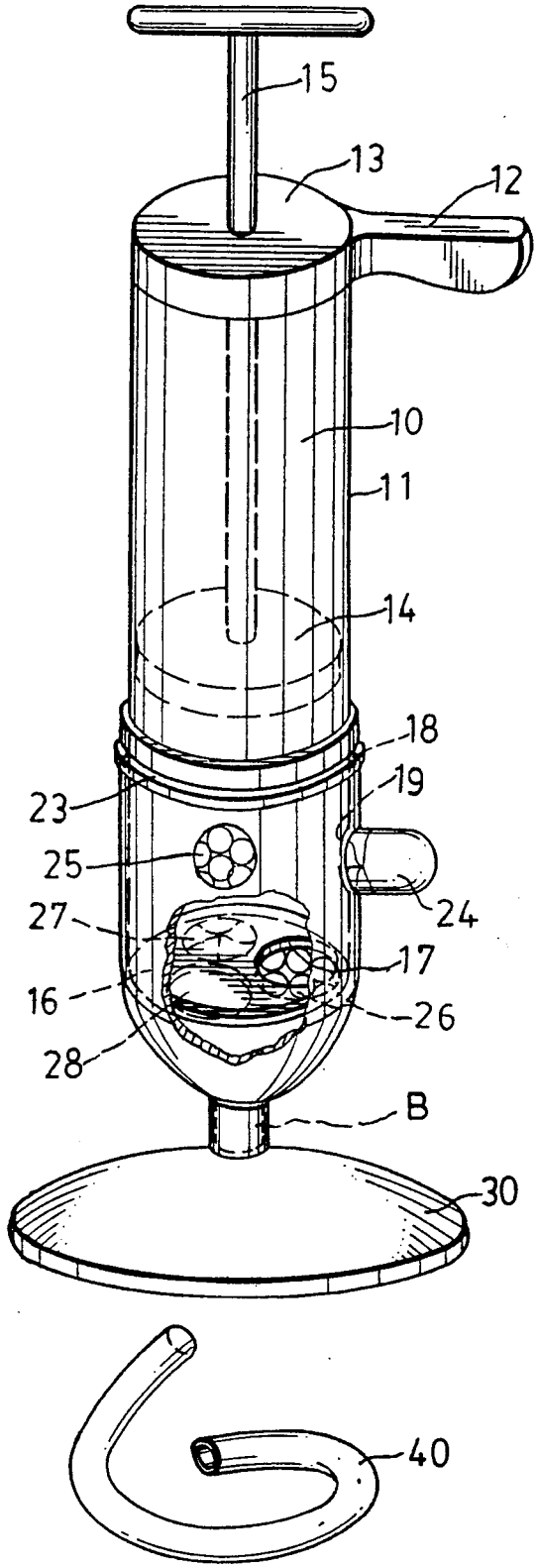
FIG. 2 is an assembled view of the manually operable pump of the present invention.

Referring to FIGS. 1 and 2, a manually operable pump of the present invention is shown to be composed of an elongated tubular member (10) and a first tubular member (20).

The elongated tubular member (10) includes an upper closed end (13), a lower closed end (16) with a first opening (17) and a first wall body (11) which interconnects the upper closed end with the lower closed end. The wall body (11) has a second opening (19) formed adjacent to the lower closed end (16). An indicator (12) is integrally formed with the upper closed end (13), which indicator is in alignment with the second opening (19). The reason for such arrangement will be described hereinafter. A suction plate (14) generally made of rubber or a flexible material is provided in the elongated tubular member (10), the edge of the suction plate forming a hermetical seal with the walls of the elongated tubular member. A pushing rod (15) with a first end centrally connects to the suction plate (14), and a second end extends through the upper closed end (13) and out of the elongated tubular member (10). When the suction plate (14) moves up and down in the elongated tubular member, a suction is produced whereby a fluid (or air) is drawn into the elongated tubular member through one of the first or second openings and then forced out of the elongated tubular member under pressure through the other opening as in a conventional pump.

The first tubular member (20) includes a top open end (A), a constricted bottom end (B) and a second wall body (21) which interconnect the top open end (A) to the constricted bottom end (B). The second wall body (21) has a first inflow check valve (24) and a first outflow check valve (25) circumferentially spaced from the first inflow check valve (24). The first inflow and outflow check valves correspond to the second opening (19) in size. A partition (22) is provided in the first tubular member (20) adjacent to the constricted bottom end (B), dividing the first tubular member into an upper portion and a lower portion. The partition (22) has a third opening (28) which is equal to the first opening (17) of the lower closed end (16) of the elongated tubular member, and a second inflow and outflow check valves (27, 26), each of which also corresponds to the first opening (16) in sizes. The first tubular member (20) also has a circumferential recess (23) formed on an inner surfaces of the same adjacent to the open top (A). The elongated tubular member (10) has a circumferential projection (18) extending outward from an outer surface of the same.

It is important to note that the first tubular member (20) is slightly larger in diameter than the elongated tubular member (10) so that the latter can be rotatably inserted into the upper portion of the former with the circumferential projections (18) being extended into the circumferential recess (23) of the first tubular member (23) as shown in FIG. 2, thereby precluding the disengagement of the elongated tubular member from the first tubular member. In short, any suitable method can be applied so long as the elongated tubular member is not disengaged from the first tubular member. Under this condition, the lower closed end (16) of the elongated tubular member (10) is in close contact with the partition (22) of the first tubular member (20).

Figure 3:
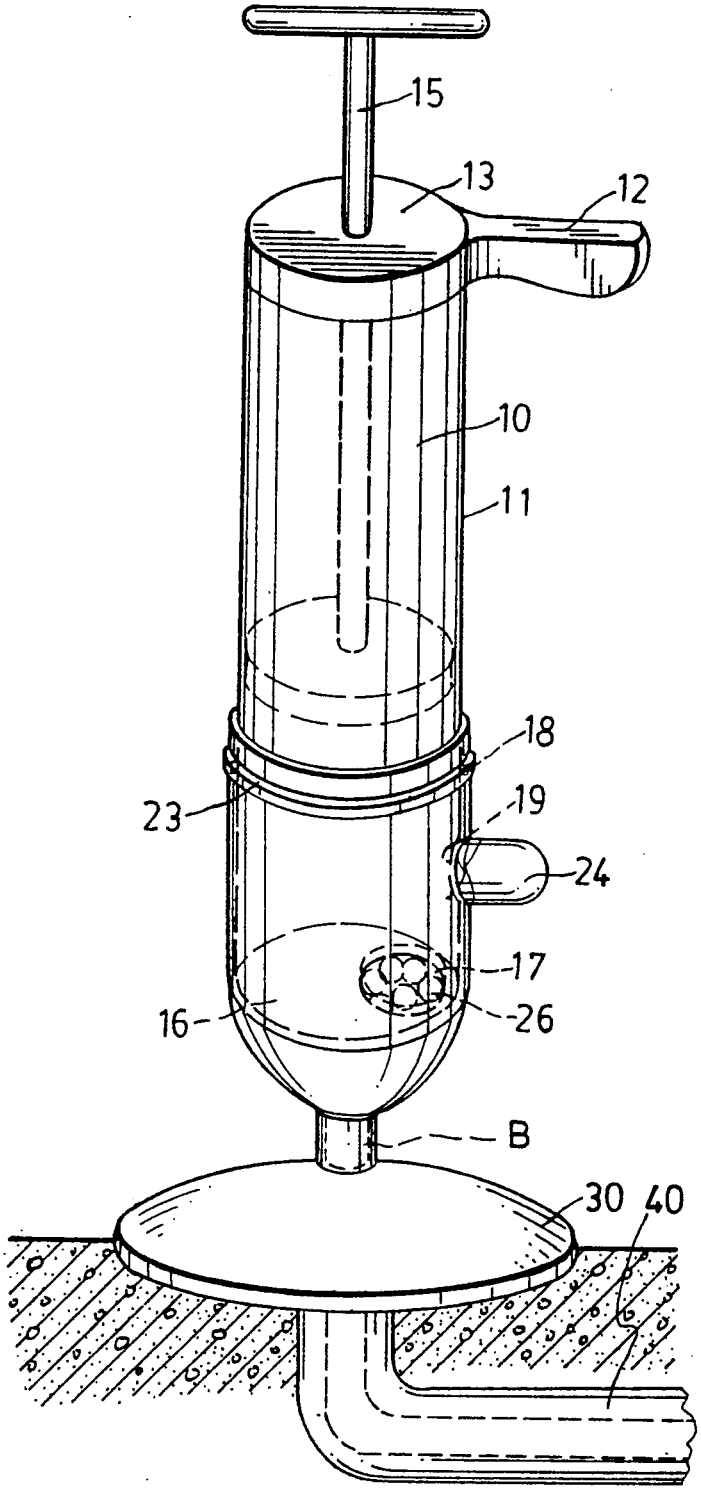
FIG. 3 shows the manually operable pump of the present invention in application in a first form.

Referring to FIG. 3, the elongated tubular member (10) is turned by pushing the indicator (12) in the first tubular member to the first position such that the openings (19) and (17) are aligned with the inflow check valve (24) and the outflow valve (26), respectively, and such that the valves (25), (27) and the third opening (28) are simultaneously correspondingly sealed. When the suction plate (14) is moved up and down in the elongated tubular member, a fluid can be drawn into the same through the cover (30) which is attached to the constricted bottom end of the first tubular member. In the event the cover (30) is placed upon a blocked passage (40), such as in a toilet bowl, the blocked passage can be opened because of the reciprocating movement of the suction plate.

Figure 4:
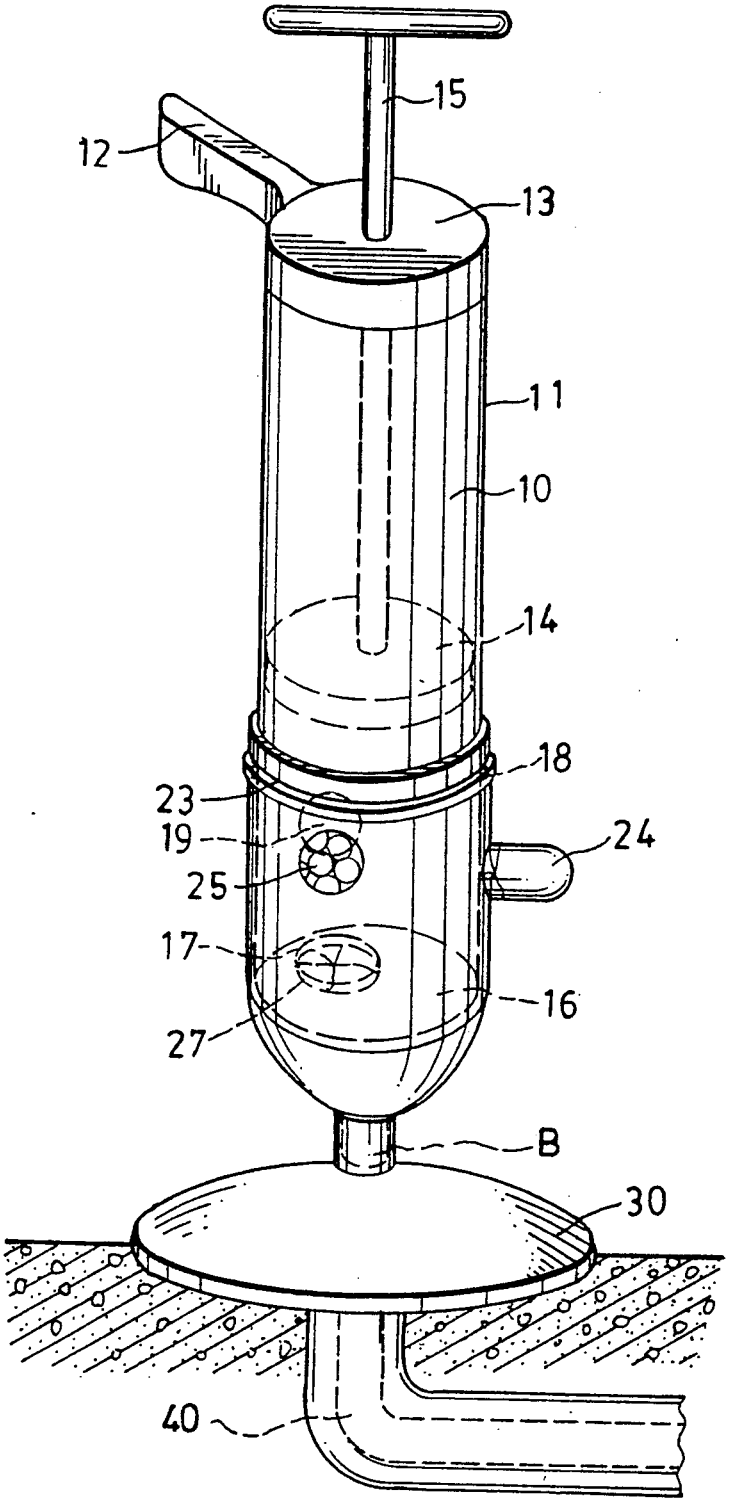
FIG. 4 shows the manually operable pump of the present invention in application in a second form.

Referring to FIG. 4, the elongated tubular member (10) is turned to a second position in the first tubular member (20), different from the first position such that the openings (19) and (17) are aligned with the first outflow check valve (25) and the second inflow check valve (27), respectively, while the first inflow check valve (24) and the second outflow check valve (26) are correspondingly sealed. The reciprocating movement of the suction plate (14) in the elongated tubular member can create a suction force and a compressive force as in the above-mentioned manner.

Figure 5:
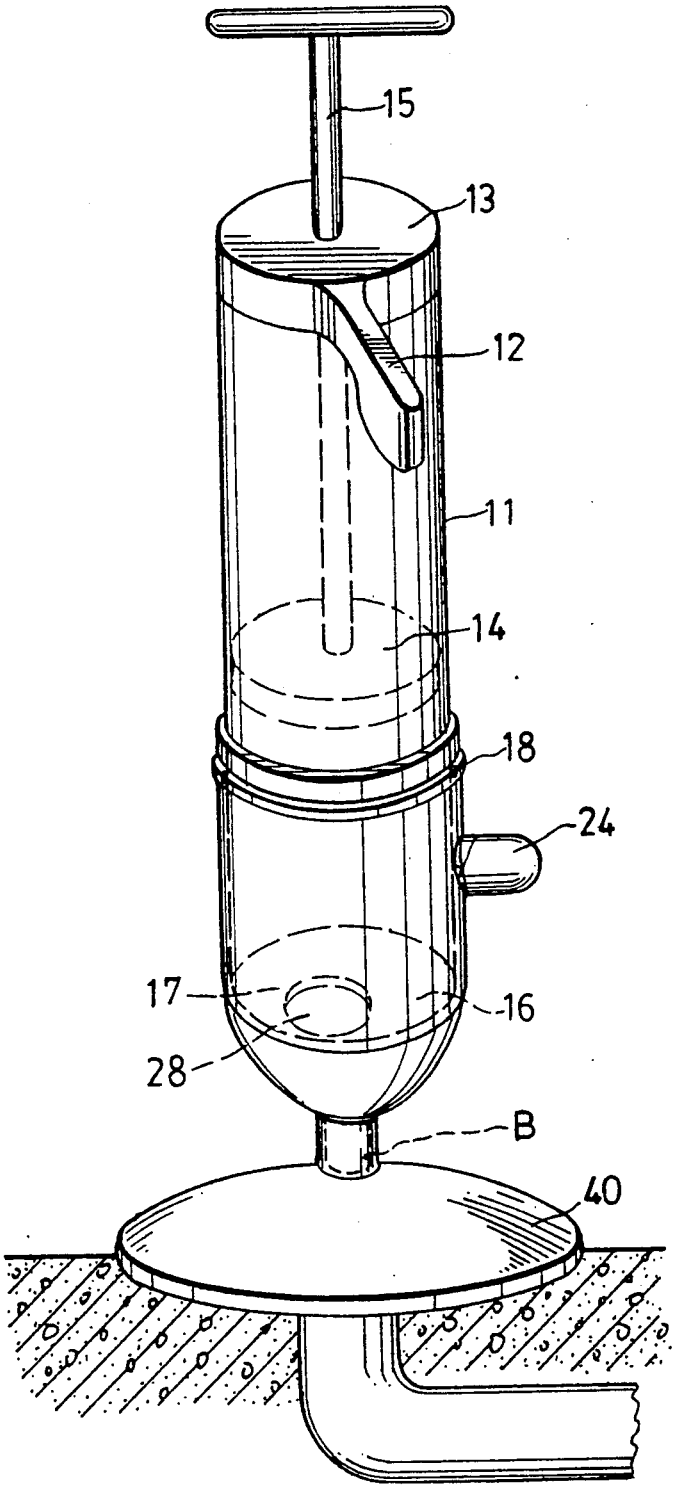
FIG. 5 shows the manually operable pump of the present invention in application in a third form.

Referring to FIG. 5, the elongated tubular member (10) is turned to a third position in the first tubular member (20), different from the second position, such that only the opening (17) of the former is aligned with the opening (28) of the latter while the remaining valve are correspondingly sealed. Under this condition, a suction force and a compressive force will be created due to the up and down movement of the suction plate (14) in the elongated tubular member (10).

It is important to note that the suction force and the compressive force of one embodiment is different from another embodiment due to different configurations of the openings and the valves which no prior art pump can provide. This is the most distinguishing feature of the present invention. The apparatus can be applied at any place one feels fit.

With the invention thus explained, it is obvious to those skilled in the art that various modifications and variations can be made without departing from the scope and spirit of the present invention. It is therefore intended that this invention be limited only as in the appended claims.

I claim:

1. A manual pump comprising:

an elongated tubular member including an upper closed end, a lower closed end and a first wall body which interconnects said upper closed end to said lower closed end, said lower closed end having a first opening and said first wall body having a second opening, and a piston movably provided in said elongated tubular member;

a first tubular member having a top open end, a constricted bottom end and a second wall body which interconnect said top open end to said constricted bottom end, said second wall body having a first inflow check valve and a first outflow check valve spaced circumferentially from said first inflow check valve, a partition being provided adjacent to said constricted bottom end dividing said first tubular member into an upper portion and a lower portion, and said partition having second inflow and outflow check valves and a third opening thereof;

said elongated tubular member being rotatably inserted into said upper portion of said first tubular member in such a manner that said lower closed end of said elongated tubular member is in contact with said partition of said first tubular member in an air proof relationship, means for engaging and permitting said elongated tubular member to rotate in said first tubular member; and said elongated tubular member being rotated in said first tubular member in a first position where said first and second openings of said elongated tubular member, respectively, are in communication with said second outflow check valve and said first inflow check valve of said first tubular member; in a second position where said first and second openings of said elongated tubular member respectively are in communication with said second inflow check valve and said first outflow check valve of said first tubular member; and in a third position where said first opening of said elongated tubular member is in communication with said third opening of said first tubular member.

2. A manual pump as claimed in claim 1, wherein said upper closed end of said elongated tubular member further includes an indicator integrally formed of the same and axially aligned with said second opening of said first wall body.

3. A manual pump as claimed in claim 1, wherein said engaging means includes a circumferential protrusion which extends from an outer surface of said first wall body and a circumferential recess formed on an inner surface of said second wall body adjacent to said top open and thereof.

* * * * *